US007410707B2

(12) United States Patent
Fukui et al.

(10) Patent No.: US 7,410,707 B2
(45) Date of Patent: Aug. 12, 2008

(54) SURFACE-COATED CUTTING TOOL

(75) Inventors: Haruyo Fukui, Itami (JP); Naoya Omori, Itami (JP)

(73) Assignee: Sumitomo Electric Hardmetal Corp., Itami-shi (JP)

( * ) Notice: Subject to any disclaimer, the term of this patent is extended or adjusted under 35 U.S.C. 154(b) by 173 days.

(21) Appl. No.: 10/560,400

(22) PCT Filed: Dec. 2, 2004

(86) PCT No.: PCT/JP2004/017925

§ 371 (c)(1),
(2), (4) Date: Dec. 12, 2005

(87) PCT Pub. No.: WO2005/053887

PCT Pub. Date: Jun. 16, 2005

(65) Prior Publication Data

US 2006/0154108 A1 Jul. 13, 2006

(30) Foreign Application Priority Data

Dec. 5, 2003 (JP) ..... 2003-408013
Feb. 24, 2004 (JP) ..... 2004-048762
Jul. 28, 2004 (JP) ..... 2004-220824

(51) Int. Cl.
*B32B 9/00* (2006.01)
*B23B 27/14* (2006.01)

(52) U.S. Cl. ..... 428/698; 51/307; 51/309; 428/216; 428/472; 428/697; 428/699

(58) Field of Classification Search ..... 428/698, 428/697, 699, 216, 472; 51/307, 309; 204/192.1, 204/192.11, 298.01, 298.04, 298.05
See application file for complete search history.

(56) References Cited

U.S. PATENT DOCUMENTS 4,842,710 A * 6/1989 Freller et al. ..... 204/192.38

(Continued)

FOREIGN PATENT DOCUMENTS

JP 08-120445 * 10/1994

(Continued)

OTHER PUBLICATIONS

S. Veprek et al., "Recent progress in the superhard nanocrystalline composites: towards their industrialization and understanding of the origin of the superhardness[1]", Surface and Coatings Technology 108-109 (1998) 138-147; Elsevier Science S.A.

(Continued)

*Primary Examiner*—Archene Turner
(74) *Attorney, Agent, or Firm*—W. F. Fasse; W. G. Fasse

(57) ABSTRACT

The present invention provides a surface-coated cutting tool comprising a coating film on a base, while the coating film comprises a hard layer constituted of a compound selected from a nitride, a carbonitride, an oxynitride and a carboxynitride of at least one primary element selected from a group consisting of the metals belonging to the groups 4a, 5a and 6a of the periodic table as well as B, Al and Si, and the hard layer satisfies the following: (a) (hmax−hf)/hmax is at least 0.2 and not more than 0.7, assuming that hmax represents the maximum indentation depth and hf represents the indentation depth (dent depth) after unloading in a hardness test according to nanoindentation, (b) the thickness of the hard layer is at least 0.5 μm and not more than 15 μm, and (c) the hardness according to nanoindentation is at least 20 GPa and not more than 80 GPa.

18 Claims, 3 Drawing Sheets

U.S. PATENT DOCUMENTS

| | | | | |
|---|---|---|---|---|
| 5,580,653 | A | 12/1996 | Tanaka et al. | |
| 5,981,049 | A * | 11/1999 | Ohara et al. | 204/192.15 |
| 6,296,928 | B1 * | 10/2001 | Yamada et al. | 428/698 |
| 6,586,122 | B2 * | 7/2003 | Ishikawa et al. | 428/697 |
| 6,767,658 | B2 * | 7/2004 | Yamamoto et al. | 51/309 |
| 6,824,601 | B2 * | 11/2004 | Yamamoto et al. | 204/192.11 |
| 7,166,155 | B2 * | 1/2007 | Ishikawa | 428/699 |
| 2003/0148145 | A1 | 8/2003 | Yamamoto et al. | |
| 2004/0137281 | A1 | 7/2004 | Ishikawa | |

FOREIGN PATENT DOCUMENTS

| | | | |
|---|---|---|---|
| JP | 07-310174 | | 11/1995 |
| JP | 09-295204 | | 11/1997 |
| JP | 11-131216 | * | 5/1999 |
| JP | 2000-087217 | | 3/2000 |
| JP | 2000-297365 | * | 10/2000 |
| JP | 2000-326108 | | 11/2000 |
| JP | 2001-349815 | | 12/2001 |
| JP | 2002-337007 | | 11/2002 |
| JP | 2003-034859 | | 2/2003 |
| JP | 2004-169076 | | 6/2004 |
| JP | 2004-176085 | | 6/2004 |
| JP | 2004-306228 | | 11/2004 |

OTHER PUBLICATIONS

S. Sasaki; "Evaluation of Mechanical Properties of Tribo-Surface with Nano-Indentation Method"; "Tribologist", vol. 47, No. 3 (2002), pp. 177 to 183, with English translation of the section headings.

* cited by examiner

SURFACE-COATED CUTTING TOOL

TECHNICAL FIELD

The present invention relates to a cutting tool comprising a coating film on a base surface. More particularly, it relates to a surface-coated cutting tool having excellent wear resistance, excellent fracture resistance and excellent chipping resistance, and being capable of improving cutting performance.

BACKGROUND ART

In general, a tool comprising a coating film of a nitride or a carbonitride of AlTiSi on a base surface of WC-based cemented carbide, cermet or high-speed steel in order to improve wear resistance and provide a surface protecting function is known as a cutting tool or a wear-resistant tool (refer to patent document 1 identified below, for example).

In response to the recent trends described below, however, the cutting edge temperature of a tool tends to increasingly rise in cutting, and characteristics required of tool materials are becoming more severe. For example, 1. dry working with no lubricant (coolant) is required in consideration of terrestrial environmental protection, 2. worked materials (workpieces) are diversified, and 3. the cutting speed is increased in order to further improve working efficiency, can be listed.

In this regard, patent document 2 identified below, for example, discloses that the performance of a cutting tool is improved also in dry high-speed cutting by providing a TiN film immediately on a base while providing a TiAlN film thereon and further providing a TiSiN film thereon. According to this patent, it is possible to solve such a problem that intra-film diffusion of oxygen can be suppressed due to an alumina layer formed by oxidation of a film surface during cutting when a TiAl compound film is provided as a coating film, while the alumina layer is so easily separated by a porous Ti oxide layer formed immediately under the alumina layer upon dynamic cutting that the progress of oxidation cannot be sufficiently prevented in general, the aforementioned porous Ti oxide layer is not formed but improvement of performance is attained by providing a dense TiSi compound film having extremely high oxidation resistance on the film surface.

Patent Document 2: Japanese Patent Laying-Open No. 2000-326108

DISCLOSURE OF THE INVENTION

Problems to be Solved by the Invention

In order to perform high-speed/high-efficiency working or dry working without any lubricant, however, it is insufficient to take into consideration only safety of the coating film under the aforementioned high temperature. In other words, it is necessary to take into consideration how to keep a coating film excellent in characteristic on a base surface in excellent adhesiveness over a long period without causing separation or fracture.

FIG. 1 is a schematic sectional view showing the structure of a typical cutting edge of a cutting tool. In a base 10, the cutting edge is generally constituted of a flank 11 and a rake face 12 as shown in FIG. 1, and the angle $\alpha$ formed by the flank 11 and the rake face 12 is acute or right in most cases. When a coating film 20 is formed on the cutting edge of this shape, the thickness c of the forward end of the cutting edge is enlarged as compared with the thicknesses a and b of the flank 11 and the rake face 12.

FIGS. 2A to 2C are schematic sectional views showing progress of wear of the coating film of the cutting tool. Describing ideal wear progress on the cutting edge in the cutting tool having the aforementioned coating film 20, wear gradually progresses from the portion of the coating film 20 located on the forward end of the cutting edge and reaches the base 10 as shown in FIG. 2C, to thereafter wear down the base 10 along with the coating film 20 while exposing the base 10 as shown in FIG. 2C.

However, the inventors have detailedly investigated the worn state of the cutting tool, to find that the wear did not progress as shown in the above FIGS. 2A to 2C but not only the coating film 20 but also the forward end of the cutting edge of the base 10 already disappeared in initial cutting as shown in FIG. 3 to expose the base 10, which has been recognized as being fractured from its configuration. Further, it has also been recognized that an exposed portion 13 was already oxidized in the base 10. Thus, it is conceivably difficult to remarkably improve the tool life due to the exposure of the base in initial cutting, despite the coating film having excellent oxidation resistance described in the aforementioned patent document 2. FIG. 3 is a schematic sectional view showing a chipped state of the cutting tool.

In a cutting tool used for high-speed working or dry working under severe conditions, therefore, it is important not only to improve oxidation resistance of a coating film as a matter of course but also to suppress fracture or chipping on a cutting edge caused in initial cutting, i.e., to suppress exposure of a base.

Accordingly, an object of the present invention is to provide a surface-coated cutting tool excellent in oxidation resistance and wear resistance and improved in fracture resistance and chipping resistance of a coating film to attain excellent cutting performance.

Means for Solving the Problems

According to an aspect of the present invention, a surface-coated cutting tool comprises a coating film on a base, while the said coating film comprises a hard layer constituted of a compound selected from a nitride, a carbonitride, an oxynitride and a carboxynitride of at least one primary element selected from a group consisting of the metals belonging to the groups 4a, 5a and 6a of the periodic table as well as B, Al and Si, and the said hard layer satisfies the following:

(a) (hmax−hf)/hmax is at least 0.2 and not more than 0.7, assuming that hmax represents the maximum indentation depth and hf represents the indentation depth (dent depth) after unloading, in a hardness test according to nanoindentation, (b) the thickness of the hard layer is at least 0.5 μm and not more than 15 μm, and (c) the hardness according to nanoindentation is at least 20 GPa and not more than 80 GPa.

Preferably, the hard layer is composed of a compound selected from a nitride, a carbonitride, an oxynitride and a carboxynitride of Ti, Al and Si.

Preferably, the hard layer is composed of a compound selected from a nitride, a carbonitride, an oxynitride and a carboxynitride of $(Ti_{1-x-y}Al_xSi_y)$ ($0 \leqq x \leqq 0.7$, $0 \leqq y \leqq 0.2$).

Preferably, the primary element contains at least one addition element selected from a group consisting of B, Mg, Ca, V, Cr, Zn and Zr, and the primary element contains less than 10 atomic % of the said addition element.

Preferably, the hard layer is composed of a compound selected from a nitride, a carbonitride, an oxynitride and a carboxynitride of $(Al_{1-a-b-c}Cr_aV_bSi_c)$ ($0 \leqq a \leqq 0.4$, $0 \leqq b \leqq 0.4$, $0 \leqq c \leqq 0.2$, $a+b \neq 0$, $0<a+b+c<1$).

Preferably, the coating film further comprises an intermediate layer formed between the base surface and the hard layer, and the said intermediate layer is constituted of any of a nitride of Ti, a nitride of Cr, Ti and Cr.

Preferably, the thickness of the intermediate layer is at least 0.005 μm and not more than 0.5 μm.

Preferably, the base is constituted of any of cemented carbide comprising WC, cermet, high-speed steel, ceramics, a cubic boron nitride sintered body, a diamond sintered body, a silicon nitride sintered body and a sintered body containing aluminum oxide and titanium carbide.

Preferably, the surface-coated cutting tool is any of a drill, an end mill, a cutting edge-replaceable insert for milling, a cutting edge-replaceable insert for turning, a metal saw, a gear cutting tool, a reamer and a tap.

Preferably, the coating film is applied by physical vapor deposition.

Preferably, the physical vapor deposition is arc ion plating or magnetron sputtering.

Effects of the Invention

According to the inventive surface-coated cutting tool, as hereinabove described, a specific effect of excellent fracture resistance and chipping resistance can be attained not only by high hardness and excellent wear resistance but also by having specific elastic recovery. Therefore, the inventive tool can effectively inhibit the base from being fractured along with the coating film in initial cutting. In the inventive tool, therefore, the coating film is hardly separated or chipped also in high-speed cutting or dry cutting with no coolant, and the tool life can be improved. The present invention is particularly suitable for cutting such as high-speed/dry cutting, interrupted cutting or heavy cutting under cutting conditions increasing the temperature of the cutting edge.

BEST MODES FOR CARRYING OUT THE INVENTION

Figure 1:
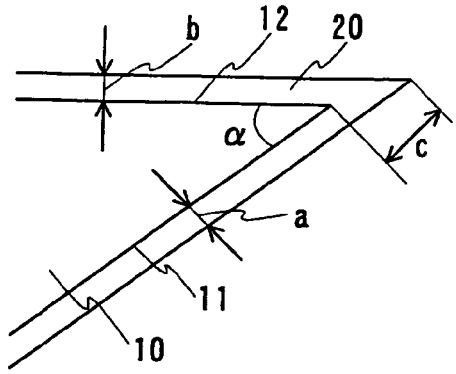
FIG. 1 is a schematic sectional view showing the structure of a typical cutting edge of a cutting tool.
Figure 2A:
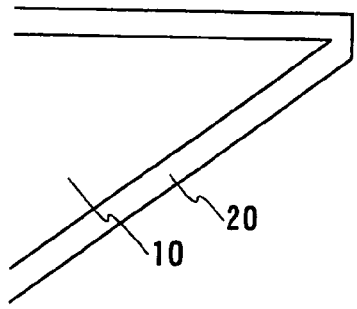
FIG. 2A is a schematic sectional view showing progress of wear of a coating film for the cutting tool, illustrating an initial cutting stage in an ideally worn state.
Figure 2B:
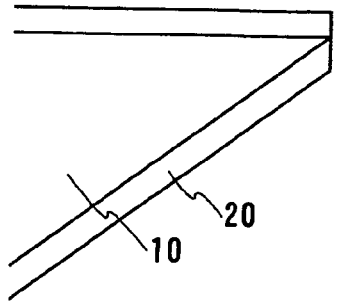
FIG. 2B is a schematic sectional view showing the progress of wear of the coating film for the cutting tool, illustrating an intermediate cutting stage in the ideally worn state.
Figure 2C:
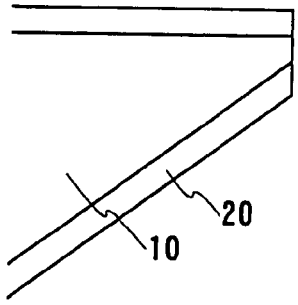
FIG. 2C is a schematic sectional view showing the progress of wear of the coating film for the cutting tool, illustrating a final cutting stage in the ideally worn state.
Figure 3:
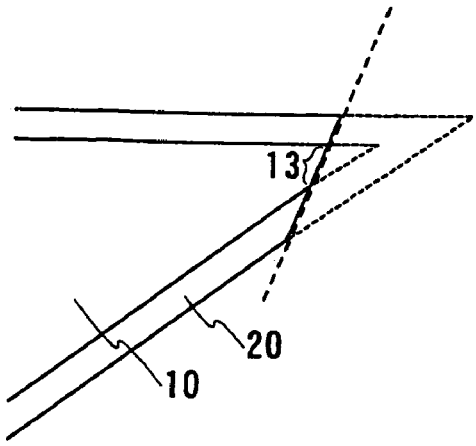
FIG. 3 is a schematic sectional view showing the state of an initial cutting stage of a conventional cutting tool.

According to the present invention, the aforementioned object is attained by defining a specific property, more specifically elastic recovery, in addition to definition of the composition, the thickness and the hardness of a coating film provided on a base.

In other words, the present invention provides a surface-coated cutting tool comprising a coating film on a base, and this coating film comprises a hard layer constituted of a compound selected from a nitride, a carbonitride, an oxynitride and a carboxynitride of at least one primary element selected from a group consisting of the metals belonging to the groups 4a, 5a and 6a of the periodic table as well as B, Al and Si, while this hard layer satisfies the following requirements (a) to (c):

(a) (hmax−hf)/hmax is at least 0.2 and not more than 0.7, assuming that hmax represents the maximum indentation depth and hf represents the indentation depth (dent depth) after unloading, in a hardness test according to nanoindentation, (b) the thickness of the hard layer is at least 0.5 μm and not more than 15 μm, and (c) the hardness according to nanoindentation is at least 20 GPa and not more than 80 GPa.

In order to attain extension of the life of the cutting tool, it is important to improve fracture resistance and chipping resistance of the cutting edge, particularly the coating film. The inventors have made investigation, to recognize that fracture or chipping caused in initial cutting can be suppressed if the coating film can be deformed to some extent to follow a load applied to the cutting edge in cutting. In other words, the fracture resistance and the chipping resistance can be improved when the coating film has specific elastic recovery. According to the present invention, therefore, the elastic recovery is particularly defined in the hard layer. (hmax−hf)/hmax is utilized as the elastic recovery assuming that hmax represents the maximum indentation depth and hf represents the indentation depth (dent depth) after unloading in the hardness test according to nanoindentation. The present invention is now described in detail.

According to the present invention, the coating film comprises the hard layer constituted of the aforementioned specific compound. The coating film may be constituted of only this hard layer, or may further comprise an intermediate layer or an outermost layer described later. The hard layer may be a singe layer or a multiple layer. It is assumed that the hard layer satisfies the aforementioned requirements for (a) the definition of the elastic recovery, (b) the thickness and (c) the hardness. When the hard layer is a multiple layer, the total thickness may satisfy the aforementioned requirement (b), and a layer positioned on a specific depth with respect to the overall hard layer may satisfy the aforementioned requirements (a) and (c). More specifically, assuming that the dent depth of an indenter for nanoindentation is about 1/10 of the total thickness, for example, a layer positioned on this depth may satisfy the aforementioned requirements (a) and (c).

The nanoindentation is now described. The nanoindentation, which is a kind of hardness test (refer to "Tribologist", Vol. 47, No. 3 (2002), pp. 177 to 183), is a technique (hereinafter referred to as a technique 1) of obtaining hardness from the relation between an indentation load on an indenter and a depth dissimilarly to a technique (hereinafter referred to as a technique 2) of obtaining hardness from a dent shape after indenter indentation performed in conventional Knoop hardness measurement or Vickers hardness measurement.

Figure 4A:
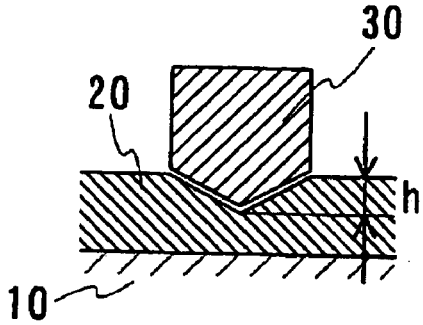
FIG. 4A is a model diagram illustrating the state of a hardness test, showing a hardness test according to nanoindentation.
Figure 4B:
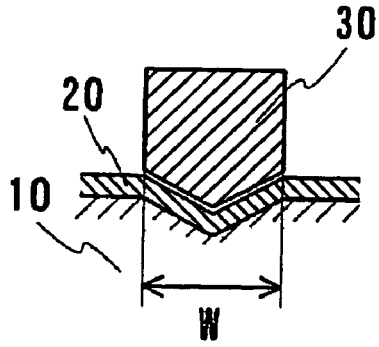
FIG. 4B is a model diagram illustrating the state of another hardness test, showing a micro Vickers hardness test.

According to the technique 2, an indentation load on an indenter 30 was so large as shown in FIG. 4B that physical property evaluation of a coating film 20 was not that of only the coating film 20 but influenced by a base 10 located under the coating film 20. It is said that it is necessary to set the indentation depth of the indenter 30 to not more than about 1/10 of the thickness in order to measure the hardness of only the coating film 20 with no influence by the base 10 provided under the coating film 20. Assuming that the thickness of the coating film 20 is 1 μm, for example, the indentation depth of the indenter 30 is desirably set to not more than 100 nm. According to the technique 2, however, the size W of the dent is observed with an optical microscope, and hence it is difficult to precisely measure the dent shape when performing the aforementioned indentation. According to the technique 1, on the other hand, the indentation depth h (FIG. 4A) can be precisely measured due to mechanical measurement also when the indentation depth of the indenter 30 is set to not more than about 1/10 of the thickness of the coating film 20.

Figure 5:
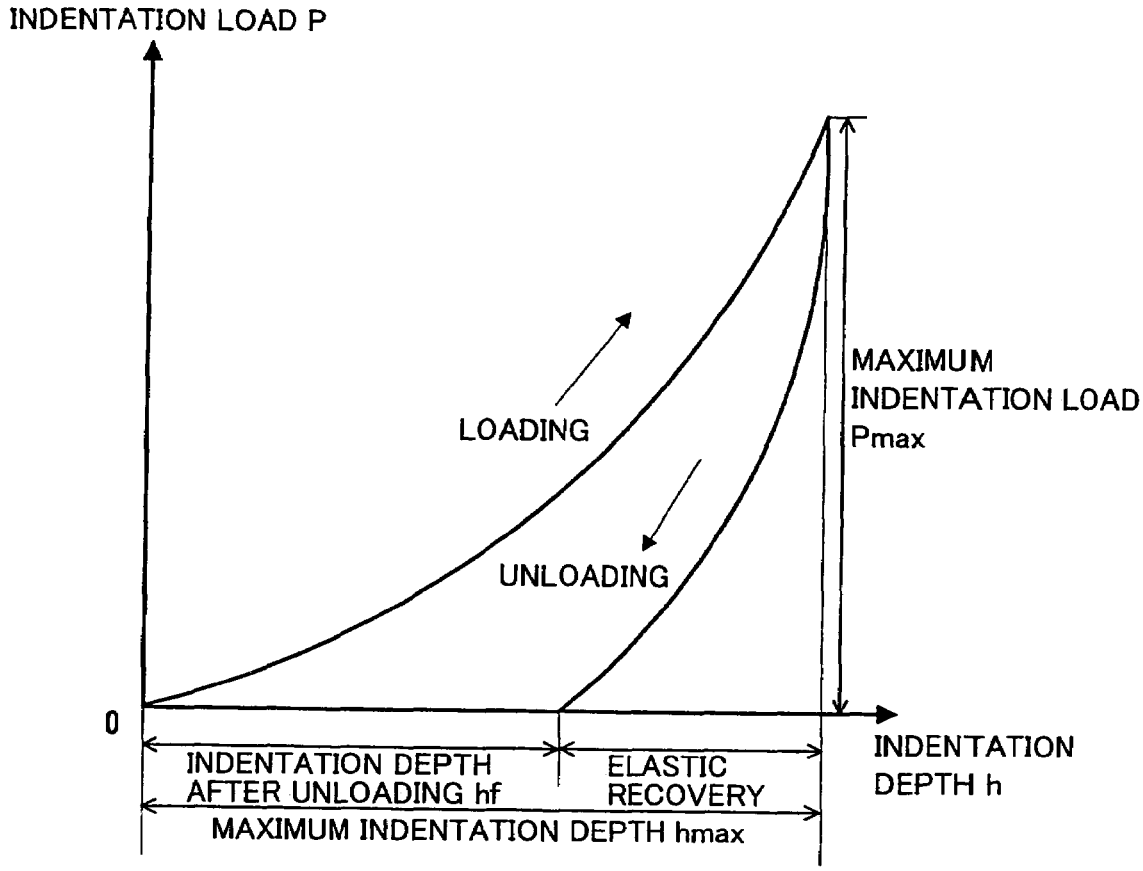
FIG. 5 is a conceptual graph showing the relation between an indentation load and an indentation depth in a case of plunging an indenter into the surface of a coating film by nanoindentation.

FIG. 5 is a conceptual graph showing the relation between an indentation load P and an indentation depth h in a case of plunging an indenter into the surface of a coating film by nanoindentation. According to the technique 2, the indentation depth is measured by gradually increasing the load on the indenter up to the maximum load and performing unloading up to zero after reaching the maximum load Pmax in general. According to the technique 1, on the other hand, not only the dent depth h after unloading but also the maximum indentation depth hmax upon indentation of the indenter is measured. The inventors define (hmax−hf)/hmax as an index showing the elastic recovery since the elastic recovery of the coating film is obtained from the difference hmax−hf between the maximum indentation depth hmax and the dent depth hf after unloading.

The coating film is easily elastically deformed but the softness thereof is so excessive that the wear resistance may be deteriorated if the aforementioned elastic recovery is large, while the coating film is increased in hardness to exhibit excellent wear resistance but the same is so hardly elastically deformed that fracture or chipping easily results from a shock in cutting if the elastic recovery is small. Therefore, the lower limit is set to 0.2 as the elastic recovery effective for improving the fracture resistance and the chipping resistance, and the upper limit is set to 0.7 as the elastic recovery necessary for attaining excellent wear resistance. More preferable elastic recovery is at least 0.3 and not more than 0.65.

The elastic recovery is also influenced by the hardness as hereinabove described, and hence the hardness of the hard layer measured by nanoindentation is preferably at least 20 GPa and not more than 80 GPa in order to obtain a cutting tool excellent in both of wear resistance and chipping resistance (fracture resistance). According to the present invention, therefore, the hardness measured by nanoindentation is defined as described above. More preferable hardness is at least 25 GPa and not more than 60 GPa, more preferably at least 25 GPa and not more than 50 GPa, and further preferably at least 25 GPa and not more than 40 GPa. Particularly in working such as continuous turning receiving a small number of repetitive shocks, a film having higher hardness is preferably excellent in wear resistance. The hardness can be controlled by changing the composition under the same film forming conditions (temperature, gas pressure, bias voltage etc.), for example. When the composition remains intact, the hardness can be controlled by changing the film forming conditions, more specifically, the temperature, the gas pressure, the bias voltage etc. in film formation. In order to attain high hardness of at least 50 GPa, in particular, the bias voltage of a substrate is increased beyond a conventional level, for example. More specifically, the bias voltage is preferably set to −250 to −450 V. When the bias voltage of the substrate is set high, incident energy of ions is so increased that the number of lattice defects introduced into the film surface in film formation is increased and remarkable strain remains in crystals constituting the film. Thus, residual stress is so increased that the hardness of the film can be conceivably improved as a result.

According to the present invention, it is assumed that the indentation load is applied in a state controlling the indentation depth of the indenter to not more than 1/10 of the film thickness in the hardness test according to nanoindentation, not to be influenced by the base provided under the coating film. According to the present invention, further, it is assumed that the hardness is measured according to nanoindentation in the aforementioned hardness test controlling the indentation load. The indentation load can be controlled by a well-known nanoindentation apparatus.

The thickness of the hard layer is set to at least 0.5 μm and not more than 15 μm. No improvement of the wear resistance is recognized if the thickness is less than 0.5 μm, while residual stress in the hard layer is increased to unpreferably reduce adhesion strength with respect to the base if the thickness exceeds 15 μm. More preferably, the thickness is at least 1.0 μm and not more than 7.0 μm. In measurement, the thickness can be obtained by cutting the cutting tool and observing the section thereof with an SEM (scanning electron microscope), for example. Further, the thickness can be changed by varying the film forming time.

The hard layer having the aforementioned characteristics is constituted of a compound selected from a nitride, a carbonitride, an oxynitride and a carboxynitride of at least one primary element selected from a group consisting of the metals belonging to the groups 4a, 5a and 6a of the periodic table as well as B, Al and Si. In other words, either a compound containing the aforementioned primary element by one or a compound containing at least two aforementioned elements may be employed. For example, the compound may contain at least one element selected from the metals belonging to the groups 4a, 5a and 6a of the periodic table and at least one element selected from the group consisting of B, Al and Si.

A film containing at least one of Ti, Al and Si as the primary element can be listed as a preferable hard layer, for example. In other words, that constituted of a nitride of Ti, Al or Si, a carbonitride of Ti, Al or Si, an oxynitride of Ti, Al or Si or a carboxynitride of Ti, Al or Si can be listed. At this time, the film is particularly preferably composed of a compound selected from a nitride, a carbonitride, an oxynitride and a carboxynitride of $(Ti_{1-x-y}Al_xSi_y)$ ($0 \leqq x \leqq 0.7$, $0 \leqq y \leqq 0.2$). All subscripts 1-x-y, x and y of the aforementioned elements denote atomic ratios, to indicate the atomic weights of the primary elements (the three elements Ti, Al and Si in this case) as a whole.

In the aforementioned compound $(Ti_{1-x-y}Al_xSi_y)$, it is assumed that at least one of Ti, Al and Si is essential as the constituent element of the hard layer and contains at least Ti. The element preferably contains Al in order to improve oxidation resistance, while the hardness of the film is reduced if the Al content is excessive, contrarily leading to a possibility of prompting wear. Therefore, the Al content (atomic ratio) x is set to $0 \leqq x \leqq 0.7$. More preferably, the Al content is $0.3 \leqq x \leqq 0.65$. The element preferably contains Si in order to improve the hardness of the film, while the film is rendered fragile if the Si content is excessive, contrarily leading to a possibility of prompting wear. When the element contains Si with the ratio y exceeding 0.2 in a case of preparing an alloy target serving as the raw material for the film by hot isostatic pressing, the alloy target may be cracked during preparation, leading to a possibility that no material strength usable for forming (coating) the film is obtained. Therefore, the Si content (atomic ratio) y is set to $0 \leqq y \leqq 0.2$. More preferably, the Si content is $0.05 \leqq y \leqq 0.15$. The contents (atomic ratios) 1-x-y, x and y of Ti, Al and Si can be varied by varying the atomic ratios of the raw material, such as the alloy target, for example, forming the film.

When the hard layer contains Ti, this film has excellent toughness. Also when load stress such as a shock is applied to the coat, therefore, this film is prevented from self rupture so that occurrence of small separation or cracking can be suppressed. Consequently, the wear resistance of the film is improved. When the hard layer contains Cr, further, the oxidation resistance of the film can be improved.

The aforementioned hard layer composed of the compound containing at least one of Ti, Al and Si, particularly the compound containing Ti, preferably contains at least one addition element selected from a group consisting of B, Mg, Ca, V, Cr, Zn and Zn. More specifically, the primary element preferably contains less than 10 atomic % of the addition element. The film containing these elements can be further improved in hardness, although the detailed mechanism has not yet been recognized. It is preferable that the hard layer contains these elements, also in consideration of the point that oxides of these elements formed by surface oxidation during cutting have functions of densifying the oxide of Al. In addition, there are such advantages that oxides of B and V having low melting points act as lubricants in cutting and that oxides of Mg, Ca, Zn and Zr have effects of suppressing agglutination of a workpiece.

As another preferable hard layer, that composed of a compound selected from a nitride, a carbonitride, an oxynitride and a carboxynitride of ($Al_{1-a-b-c}Cr_aV_bSi_c$) ($0 \leqq a \leqq 0.4$, $0 \leqq b \leqq 0.4$, $0 \leqq c \leqq 0.2$, $a+b \neq 0$, $0<a+b+c<1$). This hard layer contains not Ti but Al as a metal component so that not only oxidation resistance can be improved but also heat conductivity is increased, whereby heat generated in cutting can be expelled from the tool surface. Further, there is conceivably a function of improving lubricity on the tool surface, and it is possible to reduce cutting resistance and improve chip dischargeability by improving deposition resistance. Therefore, the Al content is preferably maximized, while the film hardness tends to lower if the Al content is excessive. Therefore, the Al content is preferably set to a level for serving as the main component of this film, more specifically at least 50 atomic %, while the upper limit is preferably set to 75 atomic % in order to prevent reduction of the film hardness. In other words, the range of 1-a-b-c is preferably at least 0.50 and not more than 0.75. Particularly preferably, the range is at least 0.6 and not more than 0.7 (at least 60 atomic % and not more than 70 atomic %). Therefore, the range of a+b+c is preferably at least 0.25 and less than 0.50 (at least 25 atomic % and less than 50 atomic %), particularly preferably at least 0.3 and less than 0.45 (at least 30 atomic % and less than 45 atomic %). All subscripts 1-a-b-c, a, b and c of the aforementioned elements denote atomic ratios, to indicate the ratios of the respective elements with reference to the total of the primary elements (the four elements Al, Cr, V and Si in this case). The aforementioned "atomic %" also indicates the ratio of each element with reference to 100% of the total of the primary elements.

Further, this hard layer contains at least either Cr or V in addition to Al. When the hard layer contains at least either Cr or V, a cubic Al compound exhibiting a metastable phase under the ordinary temperature and ordinary pressure can be formed. With reference to a nitride, for example, AlN, which is hexagonal in general, exhibits an estimated lattice constant of 4.12 Å when converted to the cubic metastable phase. On the other hand, CrN or VN exhibiting a cubic stable phase under the ordinary temperature and ordinary pressure has a lattice constant of 4.14 Å, which is extremely close to the lattice constant of the aforementioned cubic AlN. Therefore, AlN is converted from the hexagonal state to the cubic state and improved in hardness due to the so-called ziehen effect. In other words, the film containing Cr or V can be improved in hardness to have excellent wear resistance due to the cubic crystal structure of the film. Therefore, the content of Cr or V is preferably set to $0 \leqq a \leqq 0.4$ or $0 \leqq b \leqq 0.4$ (where $a+b \neq 0$). If the content a or b exceeds 0.4, there is a possibility that the film hardness is contrarily reduced to cause reduction of the wear resistance. When the hard layer contains V, the film surface is oxidized due to high-temperature environment in cutting, while such an effect can be expected that an oxide of V having a low melting point functions as a lubricant in cutting to suppress deposition of the workpiece. When the hard layer contains Cr, such an effect can be expected that an oxide of Cr formed by surface oxidation during cutting densifies the oxide of Al to improve the film hardness. In order to further improve the wear resistance, therefore, Cr is preferably added but not excessively introduced, more preferably in the ranges of $0 \leqq a \leqq 0.4$, $0 \leqq b \leqq 0.4$ and $0<a+b \leqq 0.4$.

When the hard layer contains Si, the fine structure of the film is refined from a columnar structure of 200 to 500 nm to an acicular structure of not more than 100 nm, to contribute to improvement of the film hardness. If the Si content is excessive, on the other hand, the film is so easily embrittled that the alloy target may be cracked during preparation with no material strength capable of withstanding employment for film formation. Therefore, the Si content is preferably set to $0 \leqq c \leqq 0.2$. The fine structure can be checked by TEM (transmission electron microscope) observation, for example.

In order to improve adhesiveness between the aforementioned hard layer and the base, the coating film may further comprise an intermediate layer between the base surface and the hard layer. Particularly when the intermediate layer is constituted of any of a nitride of Ti, a nitride of Cr, Ti and Cr, the aforementioned element or nitride, having excellent adhesiveness with respect to both of the hard layer and the base, can preferably further lengthen the tool life by further improving adhesion and effectively preventing the hard layer from separating from the base. The thickness of the intermediate layer is preferably at least 0.005 μm and not more than 0.5 μm. Improvement of adhesive strength is hardly obtained if the thickness is less than 0.005 μm, while no further improvement of adhesion is recognized if the thickness exceeds 0.5 μm. Both of the hard layer and the intermediate layer may have the same composition such that both layers may be films of TiN, for example. At this time, the film constituting the hard layer may satisfy the aforementioned conditions (a) to (c). Particularly when the film is formed by PVD, Ti and Cr are brought into extremely active states due to incident energy of ions into the base to cause diffusion of atoms in the base and the coating film so that the intermediate layer containing Ti and Cr can exhibit an excellent function as an adhesion layer. Therefore, the hard coating layer can be inhibited from separating from the base as compared with a case of having no intermediate layer containing no Ti or Cr, whereby the wear resistance of the cutting tool is so improved that the cutting life can be elongated.

The intermediate layer containing Ti or Cr, lower in hardness as compared with the hard coating layer, also has a function of absorbing a shock on the cutting edge in starting of cutting, and can also suppress fracture of the cutting edge caused in initial cutting.

In addition, the coating film may comprise a film of a carbide or a carbonitride as the outermost layer. More specifically, TiC, TiCN, TiSiCN and TiAlCN can be listed. When the inventors have investigated to evaluate a seizing state of a workpiece of a ferrous material such as steel by a pin-on-disc test at a specimen temperature of 800° C., seizing was hardly recognized and frictional resistance was reduced in a cutting tool comprising a film of a carbide or a carbonitride as the outermost layer, although the detailed mechanism has not yet been recognized. Thus, a film of a carbide or a carbonitride provided as the outermost layer conceivably reduces the cutting resistance to contribute to extension of the tool life.

The aforementioned coating film comprising the hard layer, the intermediate layer and the outermost layer is suitably prepared through a film forming process capable of forming a compound having high crystallinity. As a result of studying various film forming methods, the inventors have recognized that it is preferable to employ physical vapor deposition. As the physical vapor deposition, balanced magnetron sputtering, unbalanced magnetron sputtering, ion plating or the like can be listed, for example. In particular, arc ion plating (cathode arc ion plating) having a high ionization degree for raw material elements is optimum. When cathode arc ion plating is employed, metal ion bombardment processing is possible with respect to the base surface before formation of the coating film, whereby adhesiveness of the coating film can be remarkably improved, and this is a preferable process also in consideration of adhesiveness.

In order to form the hard layer having the aforementioned specific elastic recovery, refinement of crystal grains in the hard layer can be listed. More preferably, the average particle diameter is preferably set to at least 2 nm and not more than 100 nm. As a method of refining crystal grains, performance of quenching after film formation in the aforementioned film forming method can be listed, for example. In film formation by physical vapor deposition, annealing is generally performed after film formation. When not annealing but quenching is performed, on the other hand, fine crystal grains are obtained although not completely understood, and the aforementioned specific elastic recovery is conceivably attained in the case of such a fine structure. As the quenching, an operation of employing a base holder allowing water cooling and water-cooling the base holder can be listed, for example. An operation of controlling the film composition as described above, more specifically introducing a proper quantity of Si, also contributes to the refinement.

According to the present invention, the base is preferably made of one material selected from WC-based cemented carbide, cermet, high-speed steel, ceramics, a cubic boron nitride (cBN) sintered body, a diamond sintered body, a silicon nitride sintered body and a sintered body containing aluminum oxide and titanium carbide.

As the WC-based cemented carbide, that consisting of a hard phase mainly composed of tungsten carbide (WC) and a bonded phase mainly composed of an iron group metal such as cobalt (Co) and frequently employed in general may be employed. Further, that containing a solid solution composed of at least one selected from the transition metal elements belonging to the groups 4a, 5a and 6a of the periodic table and at least one selected from carbon, nitrogen, oxygen and boron may also be employed. As the solid solution, (Ta, Nb)C, VC, $Cr_2C_2$ or NbC can be listed, for example.

As the cermet, that consisting of a solid solution phase composed of at least one selected from the transition metal elements belonging to the groups 4a, 5a and 6a of the periodic table and at least one selected from carbon, nitrogen, oxygen and boron, a bonded layer composed of at least one ferrous metal and unavoidable impurities and frequently employed in general may be employed.

As the high-speed steel, W-based high-speed steel such as SKH2, SKH5 or SKH10 under JIS or Mo-based high-speed steel such as SKH9, SKH52 or SKH56 can be listed, for example.

As to the ceramics, silicon carbide, silicon nitride, aluminum nitride or aluminum oxide can be listed, for example.

As the cBN sintered body, that containing at least 30 volume % of cBN can be listed. More specifically, the following sintered bodies can be listed:

(1) A sintered body containing at least 30 volume % and not more than 80 volume % of cBN with the rest consisting of a binder, an iron group metal and unavoidable impurities. The binder contains at least one selected from a group consisting of nitrides, borides and carbides of the elements belonging to the groups 4a, 5a and 6a of the periodic table and solid solutions thereof and an aluminum compound.

In the aforementioned cBN sintered body, cBN particles, mainly bonded through the aforementioned binder having low affinity to iron frequently employed as a workpiece in strong binding, improve the wear resistance and the strength of the base. The cBN content is set to at least 30 volume % since the hardness of the cBN sintered body is so easily reduced that the hardness is insufficient for cutting a workpiece such as hardened steel, for example, having high hardness if the cBN content is less than 30 volume %. The cBN content is set to not more than 80 volume % since it is so difficult to bond the cBN particles to each other through the binder if the cBN content exceeds 80 volume %, leading to a possibility of reducing the strength of the cBN sintered body.

(2) A sintered body containing at least 80 volume % and not more than 90 volume % of cBN with cBN particles bonded to each other, with the rest consisting of a binder and unavoidable impurities. The binder is mainly composed of an Al compound or a Co compound.

In this cBN sintered body, the cBN particles can be bonded to each other and the content of the cBN particles can be increased by performing liquid phase sintering with a starting material of a metal containing Al or Co having a catalytic action or an intermetallic compound. While the wear resistance is easily reduced due to the high content of the cBN particles, the cBN particles form such a strong skeleton structure that the cutting tool is excellent in fracture resistance and capable of cutting under severe conditions. The cBN content is set to at least 80 volume % since it is difficult to form the skeleton structure by bonding the cBN particles to each other if the cBN content is less than 80 volume %. The cBN content is set to not more than 90 volume % since unsintered portions are formed due to insufficiency of the aforementioned binder having the catalytic action to result in reduction of the strength of the cBN sintered body if the cBN content exceeds 90 volume %.

As the diamond sintered body, that containing at least 40 volume % of diamond can be listed. More specifically, the following sintered bodies can be listed:

(1) A sintered body containing 50 to 98 volume % of diamond with the rest consisting of an iron group metal, WC and unavoidable impurities. As the iron group metal, Co is particularly preferable.

(2) A sintered body containing 85 to 99 volume % of diamond with the rest consisting of holes, WC and unavoidable impurities.

(3) A sintered body containing 60 to 95 volume % of diamond with the rest consisting of a binder and unavoidable impurities. The binder contains an iron group metal, at least one selected from a group consisting of carbides and carbonitrides of the elements belonging to the groups 4a, 5a and 6a of the periodic table and WC. A more preferable binder contains Co, TiC and WC.

(4) A sintered body containing at least 60 to 98 volume % of diamond with the rest consisting of at least either silicon or silicon carbide, WC and unavoidable impurities.

As the silicon nitride sintered body, that containing at least 90 volume % of silicon nitride can be listed. In particular, a sintered body containing at least 90 volume % of silicon nitride bonded through HIP (hot isostatic pressing sintering) is preferable. In this sintered body, the rest preferably consists of a binder composed of at least one selected from aluminum oxide, aluminum nitride, yttrium oxide, magnesium oxide, zirconium oxide, hafnium oxide, rare earth, TiN and TiC and unavoidable impurities.

As the sintered body containing aluminum oxide and titanium carbide, a sintered body containing at least 20% and 80% by volume of aluminum oxide and at least 15% and not more than 75% by volume of titanium carbide with the rest consisting of at least one binder selected from oxides of Mg, Y, Ca, Zr, Ni, Ti and TiN and unavoidable impurities. In particular, it is preferable that the content of aluminum oxide is at least 65 volume % and not more than 70 volume %, the content of titanium carbide is at least 25 volume % and not more than 30 volume %, and the binder is at least one selected from oxides of Mg, Y and Ca.

It is listable to assume that the tool according to the present invention is one selected from a drill, an end mill, a cutting edge-replaceable insert for milling, a cutting edge-replaceable insert for turning, a metal saw, a gear cutting tool, a reamer and a tap.

While the present invention is now described in detail with reference to Examples, the present invention is not intendedly restricted thereto.

EXAMPLE 1

The following surface-coated cutting tools were prepared for investigation of wear resistance.

(1) Preparation of Sample

Each base prepared from cemented carbide of grade P30 under JIS having an insert shape SPGN120308 under JIS was mounted on a base holder of a well-known cathode arc ion plating apparatus. As the base holder, that allowing water cooling was employed. First, the internal pressure of a chamber was reduced and the insert-shaped base was heated to a temperature of 650° C. with a heater set in the apparatus while rotating the base holder, and the chamber was evacuated until the internal pressure reached $1.0\times10^{-4}$ Pa. Then, argon gas was introduced into the chamber for holding the internal pressure of the chamber at 3.0 Pa, and the voltage of a base bias power source was gradually increased up to 1500 V, for cleaning the base surface for 15 minutes. Then, the argon gas was discharged from the chamber.

Then, alloy targets serving as metal evaporation sources for coating film components were arranged and gas for obtaining desired coating films was introduced from among nitrogen, methane and oxygen, for supplying an arc current of 100 A to a cathode while maintaining the substrate temperature, the reaction gas pressure and the base bias voltage at 650° C., 2.0 Pa and −200 V respectively for samples 1 to 29, 51 and 52 and maintaining the base bias voltage, the reaction gas pressure and the base bias voltage at 650° C., 2.0 Pa and −350 V respectively for samples 30 to 32, for generating metallic ions from the arc evaporation sources and forming coating films. The current supplied to the evaporation sources was stopped when prescribed film thicknesses were obtained. In place of annealing generally performed in this state, coating was ended by stopping the aforementioned current in the samples 1 to 32 and He gas was introduced to fill up the chamber at the same time while the samples were quenched by water-cooling the base holders. The samples 51 and 52 were ordinarily annealed. The film thicknesses were varied with film forming times. According to this Example, respective coating layers were formed under similar conditions, with hardness levels varied with compositions. Samples comprising films of Ti as intermediate layers were formed with introduction of argon gas in film formation. The coating films, formed by cathode arc ion plating in this Example, can alternatively be formed by another technique such as balanced magnetron sputtering or unbalanced magnetron sputtering, for example.

The samples 1 to 34, 51 and 52 comprising the coating films on the bases were prepared through the aforementioned steps. Table 1 shows the types and thicknesses of the coating films of the respective samples. The compositions of compounds shown in Table 1, confirmed by XPS (X-ray photoelectron spectroscopy) in this Example, can alternatively be confirmed also by microarea EDX (energy dispersive X-ray spectroscopy) analysis provided on a transmission electron microscope or SIMS (secondary ion mass spectrometry). Hardness levels of hard layers were measured by nanoindentation. Table 2 shows measured hardness levels, maximum indentation depths hmax and elastic recovery values (hmax−hf)/hmax (where hf represents dent depth remaining after unloading). Hardness measurement according to nanoindentation was performed by controlling an indentation load so that the indentation depth of an indenter was not more than 1/10 of the film thickness with respect to each hard layer. This measurement was performed with a nano-indenter (Nano Indenter XP by MTS). While all of the samples 1 to 32 exhibited fine structures with average particle diameters of 2 to 100 nm when the crystal grain sizes thereof were investigated through TEM observation, the samples 51 and 52 exhibited average particle diameters of 200 to 500 nm. In particular, the hard layers containing Si exhibited smaller values among the aforementioned average particle diameters, and had fine acicular structures.

TABLE 1

| | Coating Film | | | | |
|---|---|---|---|---|---|
| | Intermediate Layer | | Hard Layer | | |
| Sample No. | Film Type | Thickness (μm) | Film Type | Reaction Gas | Thickness (μm) |
| 1 | TiN | 0.1 | $Ti_{0.45}Al_{0.55}N$ | nitrogen | 2.5 |
| 2 | no | 0.0 | $Ti_{0.35}Al_{0.6}Si_{0.05}N$ | nitrogen | 3 |
| 3 | no | 0.0 | $Ti_{0.5}Al_{0.5}C_{0.1}N_{0.9}$ | nitrogen, methane | 4.5 |
| 4 | Cr | 0.05 | $Ti_{0.9}Si_{0.1}C_{0.1}N_{0.9}$ | nitrogen, methane | 1.5 |

TABLE 1-continued

| | Coating Film | | | | |
|---|---|---|---|---|---|
| | Intermediate Layer | | Hard Layer | | |
| Sample No. | Film Type | Thickness (μm) | Film Type | Reaction Gas | Thickness (μm) |
| 5 | no | 0.0 | $Ti_{0.4}Al_{0.4}Si_{0.2}N$ | nitrogen | 0.5 |
| 6 | no | 0.0 | $Ti_{0.45}Al_{0.45}Si_{0.05}B_{0.05}C_{0.3}N_{0.7}$ | nitrogen, methane | 2.6 |
| 7 | Ti | 0.005 | $Ti_{0.4}Al_{0.5}Si_{0.05}Mg_{0.05}C_{0.25}N_{0.7}O_{0.05}$ | nitrogen, methane, oxygen | 3.0 |
| 8 | no | 0.0 | $Ti_{0.35}Al_{0.55}Si_{0.05}Ca_{0.05}N$ | nitrogen | 5.5 |
| 9 | TiN | 0.2 | $Ti_{0.45}Al_{0.45}Si_{0.05}V_{0.05}C_{0.2}N_{0.8}$ | nitrogen, methane | 1.9 |
| 10 | no | 0.0 | $Ti_{0.45}Al_{0.45}Si_{0.05}Cr_{0.05}C_{0.4}N_{0.6}$ | nitrogen, methane | 1.5 |
| 11 | CrN | 0.3 | $Ti_{0.45}Al_{0.45}Si_{0.05}Zn_{0.05}C_{0.1}N_{0.9}$ | nitrogen, methane | 3.0 |
| 12 | TiN | 0.5 | $Ti_{0.45}Al_{0.45}Si_{0.05}Zr_{0.05}N_{0.9}O_{0.1}$ | nitrogen, oxygen | 2.2 |
| 13 | TiN | 0.15 | $Ti_{0.8}Al_{0.2}N$ | nitrogen | 15.0 |
| 14 | TiN | 0.2 | $Ti_{0.35}Al_{0.65}N$ | nitrogen | 8.7 |
| 15 | TiN | 0.1 | $Ti_{0.5}Al_{0.35}Si_{0.15}N$ | nitrogen | 6.2 |
| 16 | TiN | 0.4 | $Ti_{0.45}Al_{0.45}Zn_{0.05}Zr_{0.05}N$ | nitrogen | 2.4 |
| 17 | TiN | 0.3 | $Ti_{0.45}Al_{0.45}B_{0.05}V_{0.05}N$ | nitrogen | 2.2 |
| 18 | CrN | 0.1 | $Cr_{0.25}Al_{0.7}V_{0.05}N$ | nitrogen | 3.2 |
| 19 | TiN | 0.3 | $Cr_{0.2}Al_{0.7}Si_{0.1}C_{0.3}N_{0.7}$ | nitrogen, methane | 3.0 |
| 20 | CrN | 0.5 | $V_{0.2}Al_{0.7}Cr_{0.1}N$ | nitrogen | 3.2 |
| 21 | CrN | 0.05 | $V_{0.2}Al_{0.7}Mo_{0.1}N$ | nitrogen | 3.3 |
| 22 | TiN | 0.3 | $V_{0.2}Al_{0.7}W_{0.1}N$ | nitrogen | 3.1 |
| 23 | CrN | 0.1 | $Al_{0.7}V_{0.25}Cr_{0.05}C_{0.2}N_{0.75}O_{0.05}$ | nitrogen, methane, oxygen | 3.2 |
| 24 | no | 0.0 | $Al_{0.7}V_{0.2}Cr_{0.05}Si_{0.05}N$ | nitrogen | 2.5 |
| 25 | CrN | 0.5 | $Al_{0.65}V_{0.2}Cr_{0.1}Si_{0.05}CN$ | nitrogen, methane | 3.9 |
| 26 | Cr | 0.05 | $Al_{0.65}V_{0.35}C_{0.1}N_{0.9}$ | nitrogen, methane | 5.7 |
| 27 | no | 0.0 | $Al_{0.65}V_{0.25}Si_{0.1}N$ | nitrogen | 4.3 |
| 28 | no | 0.0 | $Al_{0.65}V_{0.35}N$ | nitrogen | 3.5 |
| 29 | no | 0.0 | $Al_{0.6}Cr_{0.3}Si_{0.1}N$ | nitrogen | 2.9 |
| 30 | Ti | 0.05 | $Al_{0.6}Ti_{0.35}Si_{0.05}N$ | nitrogen | 3.0 |
| 31 | Cr | 0.1 | $Al_{0.75}Cr_{0.2}V_{0.05}N$ | nitrogen | 3.0 |
| 32 | no | 0.0 | $Al_{0.7}Cr_{0.3}N$ | nitrogen | 3.0 |
| 33 | Cr | 0.05 | $Al_{0.7}Cr_{0.3}N$ | nitrogen | 3.0 |
| 34 | Ti | 0.05 | $Al_{0.6}Cr_{0.3}Si_{0.1}N$ | nitrogen | 2.9 |
| 51 | TiN | 0.3 | $TiC_{0.5}N_{0.5}$ | nitrogen, methane | 2.5 |
| 52 | TiN | 0.3 | $Ti_{0.5}Al_{0.5}N$ | nitrogen | 3.2 |

TABLE 2

| | Nanoindentation | | |
|---|---|---|---|
| Sample No. | Hardness (GPa) | hmax (nm) | (hmax-hf)/hmax |
| 1 | 26 | 220 | 0.45 |
| 2 | 30 | 250 | 0.50 |
| 3 | 28 | 400 | 0.67 |
| 4 | 30 | 120 | 0.55 |
| 5 | 31 | 45 | 0.62 |
| 6 | 38 | 250 | 0.30 |
| 7 | 33 | 280 | 0.44 |
| 8 | 34 | 350 | 0.65 |
| 9 | 39 | 100 | 0.41 |
| 10 | 40 | 100 | 0.49 |
| 11 | 48 | 250 | 0.38 |
| 12 | 36 | 200 | 0.54 |
| 13 | 24 | 350 | 0.25 |
| 14 | 28 | 350 | 0.21 |
| 15 | 29 | 350 | 0.47 |
| 16 | 37 | 200 | 0.56 |
| 17 | 36 | 200 | 0.43 |
| 18 | 35 | 280 | 0.55 |
| 19 | 38 | 280 | 0.48 |
| 20 | 33 | 280 | 0.54 |
| 21 | 34 | 280 | 0.58 |
| 22 | 32 | 280 | 0.61 |
| 23 | 35 | 280 | 0.28 |
| 24 | 38 | 200 | 0.31 |
| 25 | 33 | 300 | 0.37 |
| 26 | 34 | 500 | 0.55 |
| 27 | 32 | 400 | 0.45 |

TABLE 2-continued

| | Nanoindentation | | |
|---|---|---|---|
| Sample No. | Hardness (GPa) | hmax (nm) | (hmax-hf)/hmax |
| 28 | 32 | 300 | 0.40 |
| 29 | 36 | 300 | 0.38 |
| 30 | 78 | 250 | 0.50 |
| 31 | 69 | 250 | 0.38 |
| 32 | 55 | 250 | 0.44 |
| 33 | 57 | 250 | 0.46 |
| 34 | 37 | 250 | 0.40 |
| 51 | 29 | 200 | 0.15 |
| 52 | 26 | 250 | 0.10 |

(2) Evaluation of Wear Resistance

As to each of the obtained samples 1 to 34, 51 and 52, a dry continuous cutting test and an interrupted cutting test were performed under conditions shown in Table 3, for measuring the flank wear width of a cutting edge. Table 4 shows the results.

TABLE 3

| | Continuous Cutting | Interrupted Cutting |
|---|---|---|
| Workpiece | SCM435 | SCM435 |
| Cutting Speed (m/min) | 300 | 320 |

TABLE 3-continued

| | Continuous Cutting | Interrupted Cutting |
|---|---|---|
| Feed Rate (mm/rev) | 0.3 | 0.3 |
| Feed Rate (mm) | 2.0 | 1.5 |
| Feed Rate (min) | 40 | 50 |

TABLE 4

| | Flank Wear Width (mm) | |
|---|---|---|
| Sample No. | Continuous Cutting | Continuous Cutting |
| 1 | 0.077 | 0.071 |
| 2 | 0.069 | 0.069 |
| 3 | 0.084 | 0.081 |
| 4 | 0.071 | 0.073 |
| 5 | 0.062 | 0.061 |
| 6 | 0.052 | 0.049 |
| 7 | 0.061 | 0.055 |
| 8 | 0.058 | 0.057 |
| 9 | 0.059 | 0.055 |
| 10 | 0.061 | 0.052 |
| 11 | 0.051 | 0.044 |
| 12 | 0.063 | 0.05 |
| 13 | 0.102 | 0.111 |
| 14 | 0.091 | 0.098 |
| 15 | 0.074 | 0.071 |
| 16 | 0.069 | 0.067 |
| 17 | 0.071 | 0.072 |
| 18 | 0.074 | 0.072 |
| 19 | 0.075 | 0.077 |
| 20 | 0.081 | 0.079 |
| 21 | 0.079 | 0.081 |
| 22 | 0.082 | 0.085 |
| 23 | 0.058 | 0.059 |
| 24 | 0.052 | 0.051 |
| 25 | 0.045 | 0.044 |
| 26 | 0.057 | 0.057 |
| 27 | 0.049 | 0.047 |
| 28 | 0.055 | 0.056 |
| 29 | 0.050 | 0.052 |
| 30 | 0.045 | 0.081 |
| 31 | 0.049 | 0.072 |
| 32 | 0.042 | 0.056 |
| 33 | 0.038 | 0.049 |
| 34 | 0.036 | 0.041 |
| 51 | 0.234 | chipped |
| 52 | chipped | chipped |

As results of the tests, all of the samples 1 to 34 comprising coating films having specific compositions and specific elastic recovery values (hmax−hf)/hmax were normally worn without fracture or chipping. In particular, it is understood that these samples have excellent wear resistance also under the severe conditions of high-speed dry working or interrupted cutting. Further, the samples 1 to 34 were also excellent in adhesiveness with no separation of the coating films during cutting. Thus, it is assumed that only the coating films were worn in initial cutting and it was possible to gradually wear the coating films and the bases together in the samples 1 to 34. On the other hand, the samples 51 and 52 having elastic recovery values (hmax−hf)/hmax of less than 0.2 were fractured in initial cutting.

Among the samples 1 to 34, those comprising intermediate layers of any of Ti, Cr, TiN and CrN were particularly excellent in adhesiveness. Among the samples 1 to 34, further, those having hard layers of carbonitrides caused less seizure on workpieces than the samples 7, 12 and 23 having hard layers of an oxynitride and carboxynitrides respectively. Thus, it is assumed that the cutting resistance was reduced. Among the samples 1 to 17, 21 and 22, those containing at least one of B, Mg, Ca, V, Cr, Zn and Zr were higher in hardness as compared with the remaining samples. In addition, it is understood that even those having hard layers containing no Ti are excellent in cutting performance as shown in the samples 18 to 29 and 31 to 34.

Further samples were prepared by applying intermediate layers and hard layers similarly to the aforementioned samples 1 to 34 and thereafter forming outermost layers of any of TiC, TiCN, TiSiCN and TiAlCN, and the further samples were subjected to a dry continuous cutting test and an interrupted cutting test under the conditions shown in Table 3. The outermost layers were formed using a cathode arc ion plating apparatus similarly to the above (thickness: 0.5 μm). In this case, seizure was hardly caused in each sample. Thus, it has been recognized that it is possible to further reduce the cutting resistance and improve the long-life durability of the tool when providing a film of any of the aforementioned carbides or carbonitrides as the outermost layer.

EXAMPLE 2

Drills comprising coating films were obtained by preparing a plurality of bases of drills (cemented carbide K10 under JIS) having outer diameters of 8 mm and forming coating films on the bases respectively. The coating films were provided similarly to those of the samples 2, 11, 16, 19, 32, 51 and 52 in the aforementioned Example 1. These drills comprising the coating films were employed for drilling SCM440 ($H_RC30$), and the tool lives were evaluated.

The cutting conditions were a cutting speed of 90 m/min., a feed rate of 0.2 mm/rev., employment of no coolant (using air blow) and blind hole cutting of 24 mm in depth. The tool life of each sample was determined when the dimensional accuracy of a workpiece was out of a defined range and evaluated with the number of holes formed before the end of the life. Table 5 shows the results.

TABLE 5

| | | Sample 2-2 | Sample 2-11 | Sample 2-16 | Sample 2-19 | Sample 2-32 | Sample 2-51 | Sample 2-52 |
|---|---|---|---|---|---|---|---|---|
| | | Film Type | | | | | | |
| Working Content | Life Criterion | Sample 2 | Sample 11 | Sample 16 | Sample 19 | Sample 32 | Sample 51 | Sample 52 |
| Drilling | Number of Works (holes) | 5,600 | 7,600 | 4,900 | 8500 | 9,800 | 1,050 | 1,100 |

As shown in Table 5, it was confirmed that samples 2-2, 2-11, 2-16, 2-19 and 2-32 were remarkably improved in life as compared with samples 2-51 and 2-52. It was conceivably possible to improve the lives since the wear resistance as well as the fracture resistance and the chipping resistance were improved.

EXAMPLE 3

End mills comprising coating films were obtained by preparing a plurality of bases of six-flute end mills (cemented carbide K10 under JIS) having outer diameters of 8 mm and coating films were formed on the bases respectively by a method similar to that in Example 1. The coating films were prepared similarly to those of the samples 2, 11, 16, 19, 32, 51 and 52 in the aforementioned Example 1. These end mills comprising the coating films were employed for end mill side cutting of SKD 11 ($H_RC60$), and the tool lives were evaluated.

The cutting conditions were a cutting speed of 200 m/min., a feed rate of 0.03 mm/edge, a depth of cut Ad of 12 mm, Rd of 0.2 mm and employment of no coolant (using air blow). The tool life of each sample was determined when the dimensional accuracy of a workpiece was out of a defined range and evaluated with the cutting length before the end of the life. Table 6 shows the results.

TABLE 6

| | | Sample 3-2 | Sample 3-11 | Sample 3-16 | Sample 3-19 | Sample 3-32 | Sample 3-51 | Sample 3-52 |
|---|---|---|---|---|---|---|---|---|
| | | Film Type | | | | | | |
| Working Content | Life Criterion | Sample 2 | Sample 11 | Sample 16 | Sample 19 | Sample 32 | Sample 51 | Sample 52 |
| End Mill Side Cutting | Length Out Of Dimensional Accuracy | 145 m | 160 m | 140 m | 230 m | 165 m | 21 m | 28 m |

As shown in Table 6, it was confirmed that samples 3-2, 3-11, 3-16, 3-19 and 3-32 were remarkably improved in life as compared with samples 3-51 and 3-52. It was conceivably possible to improve the lives since the wear resistance as well as the fracture resistance and the chipping resistance were improved.

EXAMPLE 4

Cutting inserts were prepared by employing cBN sintered bodies for bases, for performing cutting with these cutting inserts and evaluating tool lives. Each cBN sintered body was obtained by mixing binder powder consisting of 40 mass % of TiN and 10 mass % of Al with 50 mass % of cBN powder having an average particle diameter of 2.5 μm in a cemented carbide pot and balls, charging the mixture into a cemented carbide container and sintering the same under a pressure of 5 GPa and a temperature of 1400° C. for 60 minutes. This cBN sintered body was worked into a cutting insert base having a shape SNGA120408 under ISO. A plurality of such insert bases were prepared. Coating films were formed on these insert bases respectively by a method similar to that in Example 1, for obtaining cutting inserts comprising the coating films. The coating films were provided similarly to those of the samples 2, 11, 16, 19, 32, 51 and 52 of the aforementioned Example 1. These cutting inserts comprising the coating films were employed for peripheral milling of SUJ2, a kind of hardened steel, and frank wear widths (Vb) were measured.

Cutting conditions were a cutting speed of 120 m/min., a depth of cut of 0.2 mm, a feed rate of 0.1 mm/rev. and a dry condition, and cutting was performed for 30 minutes. Table 7 shows the results.

TABLE 7

| | | Sample 4-2 | Sample 4-11 | Sample 4-16 | Sample 4-19 | Sample 4-32 | Sample 4-51 | Sample 4-52 |
|---|---|---|---|---|---|---|---|---|
| | | Film Type | | | | | | |
| Working Content | | Sample 2 | Sample 11 | Sample 16 | Sample 19 | Sample 32 | Sample 51 | Sample 52 |
| Peripheral Turning | Vb Abrasion Loss | 0.109 mm | 0.088 mm | 0.097 mm | 0.072 mm | 0.082 mm | 0.325 mm | chipped |

As shown in Table 7, it was confirmed that samples 4-2, 4-11, 4-16, 4-19 and 4-32 were superior in wear resistance as well as fracture resistance and chipping resistance as compared with samples 4-51 an 4-52.

The invention claimed is:

1. A surface-coated cutting tool comprising a coating film on a base, wherein said coating film comprises a hard layer constituted of a compound selected from a nitride, a carbonitride, an oxynitride and a carboxynitride of at least one primary element selected from a group consisting of the metals belonging to the groups 4a, 5a and 6a of the periodic table as well as B, Al and Si, and said hard layer satisfies the following:

(a) (hmax−hf)/hmax is at least 0.2 and not more than 0.7, assuming that hmax represents the maximum indentation depth and hf represents the indentation depth (dent depth) after unloading, in a hardness test according to nanoindentation, (b) the thickness of the hard layer is at least 0.5 μm and not more than 15 μm, and (c) the hardness according to nanoindentation is at least 20 GPa and not more than 80 GPa.

2. The surface-coated cutting tool according to claim 1, wherein the hard layer is composed of a compound selected from a nitride, a carbonitride, an oxynitride and a carboxynitride of Ti, Al and Si.

3. The surface-coated cutting tool according to claim 1, wherein the hard layer is composed of a compound selected from a nitride, a carbonitride, an oxynitride and a carboxynitride of $(Ti_{1-x-y}Al_xSi_y)$ $(0 \leqq x \leqq 0.7,\ 0 \leqq y \leqq 0.2)$.

4. The surface-coated cutting tool according to claim 1, wherein the primary element contains at least one addition element selected from a group consisting of Mg, Ca, V, Zn and Zr, and the primary element contains less than 10 atomic % of said addition element.

5. The surface-coated cutting tool according to claim 1, wherein the hard layer is composed of a compound selected from a nitride, a carbonitride, an oxynitride and a carboxynitride of $(Al_{1-a-b-c}Cr_aV_bSi_c)$ $(0 \leqq a \leqq 0.4,\ 0 < b \leqq 0.4,\ 0 \leqq c \leqq 0.2,\ a+b \neq 0,\ 0 < a+b+c < 1)$.

6. The surface-coated cutting tool according to claim 1, wherein the coating film further comprises an intermediate layer formed between the base surface and the hard layer, and said intermediate layer is constituted of any of a nitride of Ti, a nitride of Cr, Ti and Cr.

7. The surface-coated cutting tool according to claim 6, wherein the thickness of the intermediate layer is at least 0.005 μm and not more than 0.5 μm.

8. The surface-coated cutting tool according to claim 1, wherein the base is constituted of any of cemented carbide comprising WC, cermet, high-speed steel, ceramics, a cubic boron nitride sintered body, a diamond sintered body, a silicon nitride sintered body and a sintered body containing aluminum oxide and titanium carbide.

9. The surface-coated cutting tool according to claim 1, wherein the surface-coated cutting tool is any of a drill, an end mill, a cutting edge-replaceable insert for milling, a cutting edge-replaceable insert for turning, a metal saw, a gear cutting tool, a reamer and a tap.

10. The surface-coated cutting tool according to claim 1, wherein the coating film is applied by physical vapor deposition.

11. The surface-coated cutting tool according to claim 10, wherein the physical vapor deposition is arc ion plating or magnetron sputtering.

12. The surface-coated cutting tool according to claim 1, wherein said hard layer is made up of crystal grains having an average particle diameter in a range from 2 nm to 100 nm.

13. The surface-coated cutting tool according to claim 1, wherein said hardness is at least 55 GPa.

14. The surface-coated cutting tool according to claim 1, wherein said (hmax−hf)/hmax is less than 0.28.

15. The surface-coated cutting tool according to claim 1, wherein said (hmax−hf)/hmax is at least 0.43.

16. The surface-coated cutting tool according to claim 1, wherein said (hmax−hf)/hmax is at least 0.48.

17. The surface-coated cutting tool according to claim 1, wherein said (hmax−hf)/hmax is at least 0.54.

18. The surface-coated cutting tool according to claim 1, having such characteristics as result from fabricating said surface-coated cutting tool by mounting said base on a base holder, performing a film forming process in a chamber to deposit said hard layer on said base, stopping said film forming process and filling helium gas into said chamber, and quenching by water-cooling said base holder.

* * * * *

UNITED STATES PATENT AND TRADEMARK OFFICE

CERTIFICATE OF CORRECTION

PATENT NO. : 7,410,707 B2
APPLICATION NO. : 10/560400
DATED : August 12, 2008
INVENTOR(S) : Fukui et al.

It is certified that error appears in the above-identified patent and that said Letters Patent is hereby corrected as shown below:

Column 1,
Following Line 45, insert
--Patent Document 1: Japanese Patent Laying-Open No. 7-310174--;

Column 15,
Table 4, in the third column heading replace "Continuous" by --Interrupted--.

Signed and Sealed this

Fifteenth Day of September, 2009

David J. Kappos

David J. Kappos
*Director of the United States Patent and Trademark Office*